United States Patent [19]

Iwata

[11] 4,413,781

[45] Nov. 8, 1983

[54] FUEL INJECTION NOZZLE

[75] Inventor: Masatoshi Iwata, Oyama, Japan

[73] Assignee: Kabushiki Kaisha Komatsu Seisakusho, Tokyo, Japan

[21] Appl. No.: 332,736

[22] Filed: Dec. 21, 1981

[30] Foreign Application Priority Data

Dec. 22, 1980 [JP] Japan ..... 55-183182[U]
Dec. 22, 1980 [JP] Japan ..... 55-183183[U]

[51] Int. Cl.[3] ..... F02M 67/04
[52] U.S. Cl. ..... 239/91; 239/409
[58] Field of Search ..... 239/88–95, 239/407–409

[56] References Cited

U.S. PATENT DOCUMENTS 1,393,090 10/1921 Cowardin ..... 239/408 X
1,560,025 11/1925 De Young ..... 239/408 X
4,141,329 2/1979 Pompei ..... 239/91 X

*Primary Examiner*—Andres Kashnikow
*Attorney, Agent, or Firm*—Armstrong, Nikaido, Marmelstein & Kubovcik

[57] ABSTRACT

A nozzle for injecting fuel premixed with air into the combustion chamber of a diesel engine cylinder. Included is a piston reciprocably mounted in a nozzle body to define in combination with the nozzle body an air chamber for receiving compressed air from the combustion chamber of the engine cylinder and a fuel chamber for receiving fuel from a fuel injection pump. Formed integral with the piston, a needle valve is adapted to open and close spray holes opening to the combustion chamber. Formed in the piston is a passage having a check valve mounted therein for allowing air to pass from the air chamber to the fuel chamber.

Thus, upon descent of the piston at the end of the compression stroke, the fuel is intimately premixed with the compressed air from the air chamber, prior to the introduction into the combustion chamber.

13 Claims, 5 Drawing Figures

FUEL INJECTION NOZZLE

BACKGROUND OF THE INVENTION

This invention relates to a fuel injection nozzle for atomizing and spraying each metered charge of fuel, premixed with air, into the combustion chamber of a cylinder in an internal combustion engine such as, typically, a diesel engine.

Some early diesel engines employed an air-injection system, such that the fuel was atomized into the cylinder under air pressure. Although the system admittedly provided excellent smoke-free combustion, it required expensive and bulky multistage compressors and intercoolers for injection air. Consequently, with the advent of spray nozzles capable of sufficiently atomizing the fuel by use of fuel pressure alone, the solid or airless injection has become the generally accepted method of fuel injection in compression-ignition engines.

Recently, however, it is being contemplated to inject fuel into diesel engine cylinders at pressures in the order of 1000 kgf/cm$^2$, with a view to higher engine efficiency and minimal exhaustion of air pollutants. The usual airless injection method does not necessarily provide good combustion at such ultrahigh pressures.

SUMMARY OF THE INVENTION

The present invention aims at the provision of an improved fuel injection nozzle for the delivery of premixed fuel and air into the combustion chamber of an engine cylinder, so made that the fuel can be finely atomized and vaporized and intimately blended with air to provide optimum combustion. In attaining this objective, moreover, the invention seeks to eliminate the need for bulky and expensive equipment conventionally required for injection air. The invention also seeks to positively terminate the injection of each charge of fuel-air mixture and hence to avoid improper combustion due to prolonged injection.

According to an aspect of the present invention, there is provided a fuel injection nozzle for the delivery of fuel, premixed with air, to the combustion chamber of a cylinder in an internal combustion engine, comprising: (a) a nozzle body having formed therein an axial passage and at least one spray hole for communicating the axial passage with the combustion chamber of the engine cylinder; (b) a piston slidably mounted in said nozzle body for reciprocating movement between a first and a second position and defining in combination therewith a first and a second chamber therein; (c) said nozzle body having formed therein a fuel inlet port and an air inlet port, the fuel inlet port being open to the second chamber when said piston is in the first position and being closed when said piston is in the second position, the air inlet port being open to the first chamber when said piston is in the second position and being closed when said piston is in the first position; (d) a valve member fixedly secured to said piston and therefore reciprocable in the axial passage of said nozzle body between the first and second positions for opening and closing the spray hole, the communication between the second chamber and the axial passage being blocked when said valve member is between the first position and a third position which is intermediate the first and second positions and being established when said valve member is between the second and third positions; (e) conduit means for communicating the air inlet port with the combustion chamber; and (f) means mounted in said piston for allowing the air flow from the first chamber to the second chamber but blocking the flow in the opposite direction.

In accordance with another aspect of the present invention, there is provided a fuel injection nozzle for the delivery of fuel, premixed with air, to the combustion chamber of a cylinder in an internal combustion engine, comprising: (a) a nozzle body having formed therein an axial passage and at least one spray hole for communicating the axial passage with the combustion chamber of the engine cylinder; (b) a piston slidably mounted in said nozzle body for reciprocating movement between a first and second position and defining in combination therewith a first and a second chamber therein; (c) said nozzle body having formed therein a fuel inlet port and an air inlet port which is open to the first chamber when said piston is in the second position and is closed when said piston is in the first position, the fuel inlet port being in communication with the axial passage; (d) a valve member fixedly secured to said piston and therefore reciprocable in the axial passage of said nozzle body between the first and second positions for opening and closing the spray hole, the communication between the second chamber and the axial passage being blocked when said valve member is between the first position and a third position which is intermediate the first and second positions and being established when said valve member is between the second and third positions; (e) conduit means for communicating the air inlet port with the combustion chamber; and (f) means mounted in said piston for allowing the air flow from the first chamber to the second chamber but blocking the flow in the opposite direction.

The above and other objects, features and advantages of the present invention and the manner of attaining them will become more apparent, and the invention itself will best be understood from a study of a following description taken in conjunction with the accompanying drawings.

DESCRIPTION OF THE PREFERRED EMBODIMENTS

Figure 1:
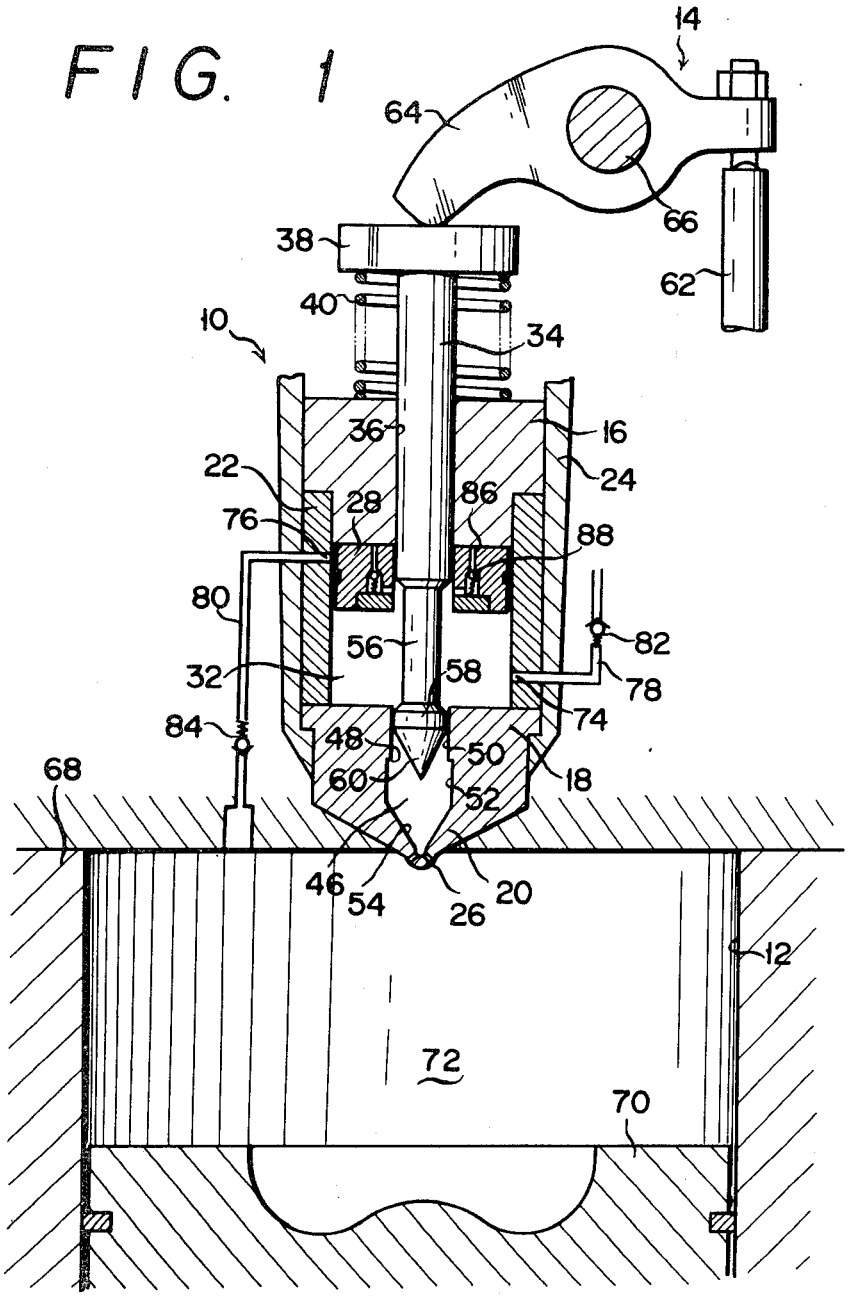
FIG. 1 is an axial sectional view, partly in elevation, of the fuel injection nozzle constructed in accordance with the present invention, shown together with its actuating mechanism and a diesel engine cylinder into which the premixed fuel and air is to be injected by the nozzle.
Figure 2:
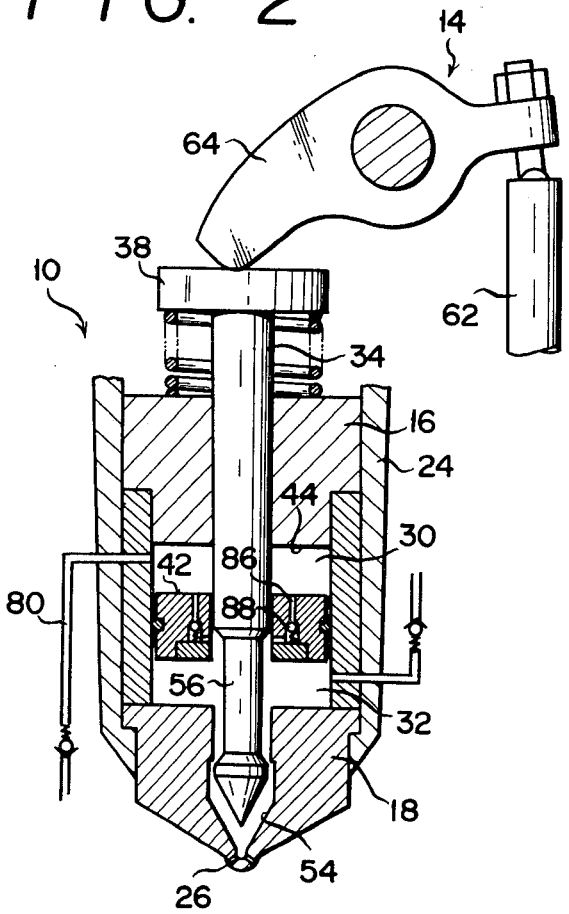
FIG. 2 is a view similar to FIG. 1 except that the nozzle is shown in the injection state.
Figure 3:
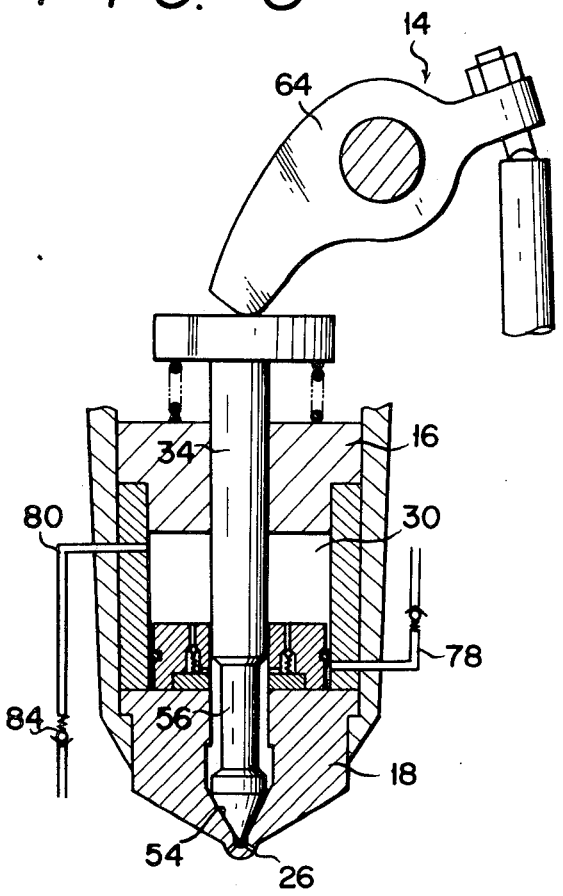
FIG. 3 is a view similar to FIG. 1 except that the nozzle is shown in a state at the end of the injection.

FIGS. 1 to 3 show a preferred form of the fuel injection nozzle according to this invention, in different phases of operation. Generally designated 10, the nozzle is therein shown mounted in position on a diesel engine cylinder 12 and together with an actuating mechanism 14. The nozzle 10 comprises a body 16, a cap 18 having a conical tip 20 at its bottom end, a cylindrical member 22 disposed between the body 16 and the cap 18, and a holder 24 for holding them together. One or more spray holes 26 are formed centrally in the conical nozzle tip 20. Although the nozzle body 16, the cap 18, the cylindrical member 20 and the holder 24 form separate units to facilitate assemblage of the complete device, they may be considered integral for the purpose of the invention.

Slidably and pressure-tightly mounted in the cylindrical member 22 for up-and-down reciprocation is a piston 28 defining in combination with the body 16, cap 18 and cylindrical member 22 an air chamber 30 and a fuel or premixing chamber 32 for premixing and pressurizing fuel and air to be injected. The piston 28 is fixedly secured to a stem 34 extending upwardly and downwardly therethrough. The stem 34 projects out of the nozzle body 16 through a bore 36 in the nozzle body 16 and terminates in a flange 38 on its outer end. A helical compression spring 40 extends between the nozzle body 16 and the stem flange 38 for normally holding the piston 28 in a first or raised position shown in FIG. 1, in which the top 42 of the piston 28 abuts against the bottom surface 44 of the nozzle body 16.

The cap 18 has formed therein an axial passage 46 communicating at its top end with the premixing chamber 32 and at its bottom end with the spray holes 26. The axial passage 46 has an annular step 48 at an intermediate position thereof dividing the same into an upper smaller diameter section 50 and a lower larger diameter section 52. Lower half of the larger diameter passage section 52 is formed in a conical seat 54 converging into the spray holes 26.

Formed integral with the stem 34 and downwardly projecting from the piston 28 is a needle valve 56 for opening and closing the spray holes 26. The needle valve 56 has a head 58 adapted to snugly fit in the upper passage section 50 and terminates in a conical tip 60 adapted to seat on the conical seat 54 of the cap 18 for closing the spray holes 26.

The actuating mechanism 14 comprises a pushrod 62 driven by the engine camshaft, not shown, and a rocker arm 64 coupled at one end to the pushrod 62 and abutting at the other end against the flange 38 of the stem 34. Pivotally supported at 66, the rocker arm 64 oscillates with the rectilinear reciprocation of the pushrod 62, depressing the stem 34 against the force of the compression spring 40 with each pivotal motion in a counterclockwise direction.

Labeled 68 is the cylinder block of the diesel engine under consideration. The cylinder 12 formed in the cylinder block 68 has a piston 70 reciprocably mounted therein so as to define a combustion chamber 72. The spray holes 26 of the fuel injection nozzle 10 are open to this combustion chamber 72.

The cylindrical member 22 has formed therein a fuel inlet port 74 and an air inlet port 76 in communication with a suitable fuel supply, not shown, and the combustion chamber 72 through conduits 78 and 80 having check valves 82 and 84 mounted therein, respectively. The piston 28 has formed therein a plurality of passages 86 in which check valves 88 are mounted for allowing air flow from the air chamber 30 to the premixing chamber 32 but blocking the flow in the opposite direction.

In operation, referring to FIG. 3 showing the injection nozzle 10 at the end of fuel injection, the needle valve 56 seats on the conical seat 54 of the cap 18 thereby closing the spray holes 26. The rocker arm 64 holds the needle valve 56 at this position until the end of the exhaust stroke of the piston 70. During this exhaust stroke, part of the compressed and high temperature air and combustion gas mixture enters into the air chamber 30 through the check valve 84. Upon the end of the exhaust stroke, the needle valve 56 and the piston 28 are raised to a state shown in FIG. 1 by the force of the compression spring 40. During this upwards movement of the piston 28, air and combustion gas mixture temporarily stored in the air chamber 30 is introduced into the premixing chamber 32 through the passages 86 and the check valves 88.

While the piston 28 is at this raised position shown in FIG. 1, fuel is delivered under relatively low pressure through the conduit 78 and the check valve 82 from its unshown source to the premixing chamber 32 where it is admixed with the compressed and high temperature air and combustion gas mixture.

The stem 34 is pressed down by the actuating mechanism 14 at the end of the compression stroke further compressing fuel and air mixture stored in the premixing chamber 32. Fuel injection starts when the head 58 of the needle valve 56 passes the step 48 of the axial passage 46 as shown in FIG. 2. Since the highly compressed fuel and air mixture passes through the narrow path between the head 58 of the needle valve 56 and the axial passage wall of the larger diameter lower passage section 52, the high speed stream of the compressed air atomizes and intimately mingles with the fuel. The fuel-air mixture is subsequently sprayed from the spray holes 26 into the combustion chamber 72 of the engine cylinder 12, therein to be ignited by the air compressed to a high temperature.

It should be appreciated that the fuel is admixed with the compressed and high temperature air in the premixing chamber 32. Such high temperature air promotes the vaporization of the fuel in the premixing chamber 32. Further the air streams passing through the narrow path between the head 58 of the needle valve 56 and the passage wall of the larger diameter passage section 52 have such high speed that the fuel can be thoroughly mixed with the air and injected into the combustion chamber 72 in a fine spray. Still further, for all these advantages offered by the high speed streams of air under pressure, the invention requires no source of such air external to the engine proper.

Figure 4:
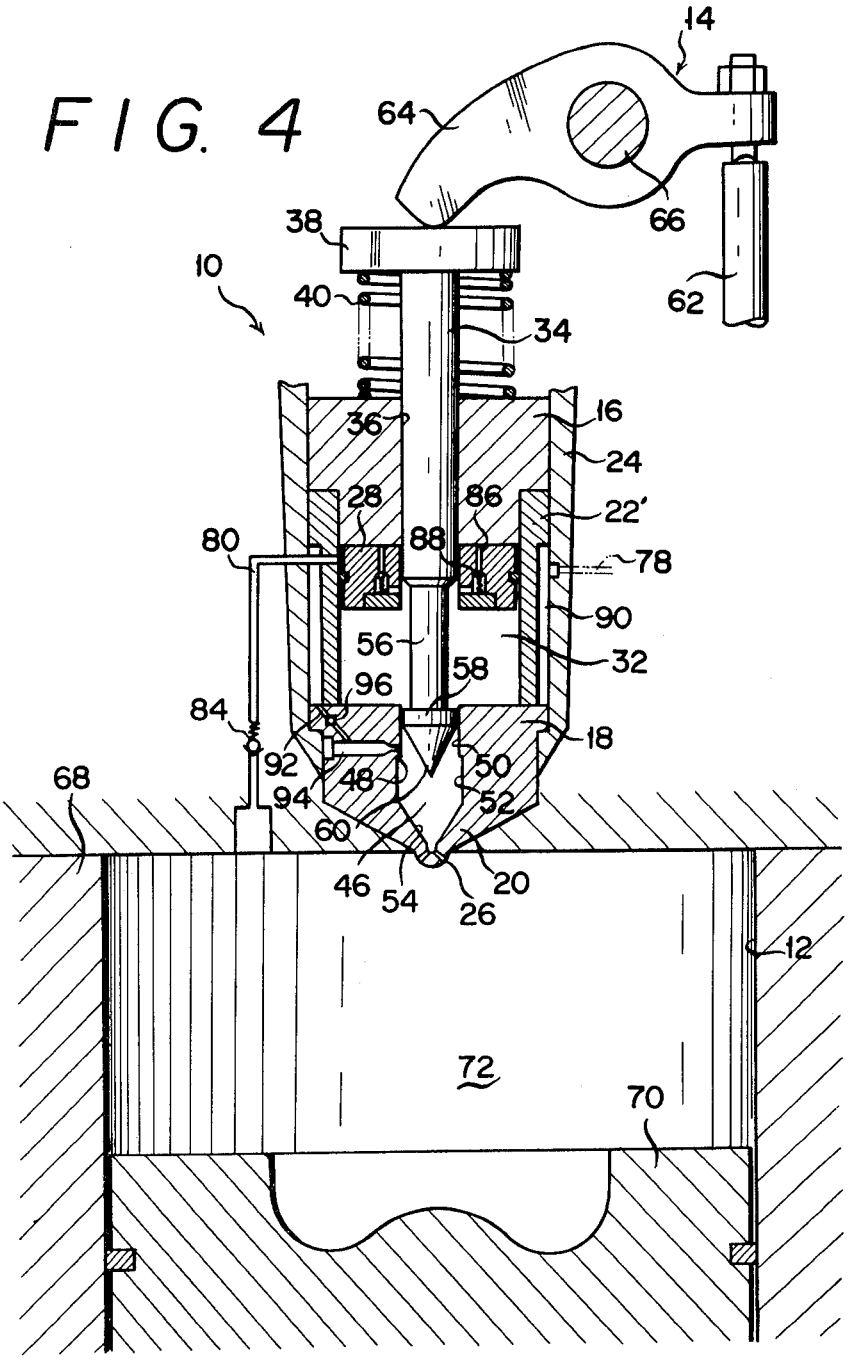
FIG. 4 is a view similar to FIG. 1 but showing another embodiment of the present invention.
Figure 5:
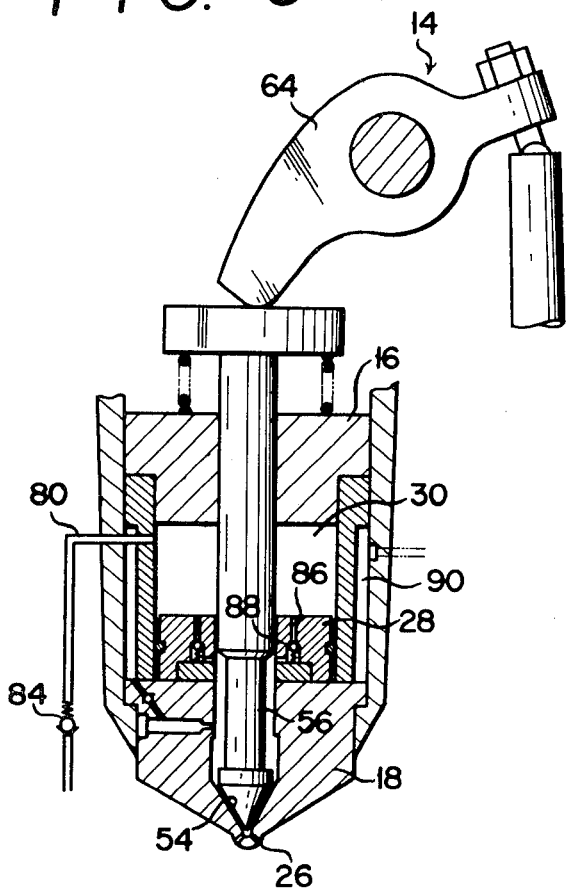
FIG. 5 is a view similar to FIG. 4 except that the nozzle is shown in a state at the end of the injection.

FIGS. 4 and 5 show another embodiment of the fuel injection nozzle according to the present invention, which is identical to the first mentioned embodiment except that fuel is delivered to the axial passage 46 instead of being delivered to the chamber 32. A fuel chamber 90 is formed in a cylindrical member 22′ radially surrounding the chambers 30 and 32 for receiving fuel from the conduit 78. The fuel chamber 90 is in communication with the upper section 50 of the axial passage 46 through passages 92 and 94. A check valve 96 is disposed in the passage 92.

In operation, referring to FIG. 5 showing the injection nozzle 10 at the end of fuel injection, the needle valve 56 seats on the conical seat 54 of the cap 18 thereby closing the spray holes 26. The rocker arm 64 holds the needle valve 56 at this position until the end of the exhaust stroke of the piston 70. During this exhaust stroke, part of the compressed and high temperature air and combustion gas mixture enters into the air chamber 30 through the check valve 84. Upon the end of the exhaust stroke, the needle valve 56 and the piston 28 are raised to a state shown in FIG. 4 by the force of the compression spring 40. During this upwards movement of the piston 28, air and combustion gas mixture temporarily stored in the air chamber 30 is introduced into the chamber 32 through the passages 86 and the check valves 88.

While the piston 28 is at this raised position shown in FIG. 4, fuel is delivered under relatively low pressure from its unshown source to the axial passage 46 through the conduit 78, fuel chamber 90 and passages 92 and 94.

The stem 34 is pressed down by the actuating mechanism 14 at the end of the compression stroke further compressing the air stored in the chamber 32. Fuel injection starts when the head 58 of the needle valve 56 passes the step 48 of the axial passage 46. Since the highly compressed air passes through the narrow path between the head 58 of the needle valve 56 and the axial passage wall of the larger diameter lower passage section 52, the high speed stream of the compressed air atmizes and intimately mingles with the fuel temporarily stored in the axial passage 46. The fuel-air mixture is subsequently sprayed from the spray holes 26 into the combustion chamber 72 of the engine cylinder 12, therein to be ignited by the air compressed to a high temperature.

Since in this embodiment, fuel can be preheated by the compressed and high temperature air in the chamber 32 while it is in the chamber 90, vaporization of the fuel can be promoted thereby.

While the fuel injection nozzle according to this invention has been shown and described in terms of its preferred embodiments, it is to be understood that changes and modifications may be made in the details of its construction and in its relations with the other parts of the engine in which it is incorporated, without departing from the spirit of the invention as expressed in the following claims.

What is claimed is:

1. A fuel injection nozzle for the delivery of fuel, premixed with air, to the combustion chamber of a cylinder in an internal combustion engine, comprising:

(a) a nozzle body having formed therein an axial passage and at least one spray hole for communicating the axial passage with the combustion chamber of the engine cylinder;

(b) a piston slidably mounted in said nozzle body for reciprocating movement between a first and a second position and defining in combination therewith a first and a second chamber therein;

(c) said nozzle body having formed therein a fuel inlet port and an air inlet port, the fuel inlet port being open to the second chamber when said piston is in the first position and being closed when said piston is in the second position, the air inlet port being open to the first chamber when said piston is in the second position and being closed when said piston is in the first position;

(d) a valve member fixedly secured to said piston and therefore reciprocable in the axial passage of said nozzle body between the first and second positions for opening and closing the spray hole, the communication between the second chamber and the axial passage being blocked when said valve member is between the first position and a third position which is intermediate the first and second positions and being established when said valve member is between the second and third positions;

(e) conduit means for communicating the air inlet port with the combustion chamber; and (f) means mounted in said piston for allowing the air flow from the first chamber to the second chamber but blocking the flow in the opposite direction.

2. A fuel injection nozzle according to claim 1 wherein said axial passage comprises a first cylindrical section having a first diameter and a second cylindrical section having a second diameter larger than the first diameter and wherein said valve member is a needle valve having a cylindrical head and a conical tip for opening and closing the spray hole in said nozzle body, said cylindrical head being adapted to snugly fit in the first cylindrical section of said axial passage.

3. A fuel injection nozzle according to claim 1 further comprises check valve means provided in said conduit means for allowing the air flow from the combustion chamber to the air inlet port but blocking the flow in the opposite direction.

4. A fuel injection nozzle according to claim 1, further comprising spring means for normally holding the piston in the first position.

5. A fuel injection nozzle according to claim 4, wherein the piston is formed integral with a stem slidably extending through and projecting out of one end of the nozzle body, the stem having a flange on its outer end, and wherein the spring means is a compression spring extending between the flange of the stem and said one end of the nozzle body.

6. A fuel injection nozzle according to claim 5, in combination with an actuating mechanism acting on the flange of the stem for moving the piston from the first to the second position against the force of the spring means.

7. A fuel injection nozzle for the delivery of fuel, premixed with air, to the combustion chamber of a cylinder in an internal combustion engine, comprising:

(a) a nozzle body having formed therein an axial passage and at least one spray hole for communicating the axial passage with the combustion chamber of the engine cylinder;

(b) a piston slidably mounted in said nozzle body for reciprocating movement between a first and a second position and defining in combination therewith a first and a second chamber therein;

(c) said nozzle body having formed therein a fuel inlet port and an air inlet port which is open to the first chamber when said piston is in the second position and is closed when said piston is in the first position, the fuel inlet port being in communication with the axial passage;

(d) a valve member fixedly secured to said piston and therefore reciprocable in the axial passage of said nozzle body between the first and second positions for opening and closing the spray hole, the communication between the second chamber and the axial passage being blocked when said valve member is between the first position and a third position which is intermediate the first and second positions and being established when said valve member is between the second and third positions;

(e) conduit means for communicating the air inlet port with the combustion chamber; and (f) means mounted in said piston for allowing the air flow from the first chamber to the second chamber but blocking the flow in the opposite direction.

8. A fuel injection nozzle according to claim 7 wherein said axial passage comprises a first cylindrical section having a first diameter and a second cylindrical section having a second diameter larger than the first diameter and wherein said valve member is a needle valve having a cylindrical head and a conical tip for opening and closing the spray hole in said nozzle body, said cylindrical head being adapted to snugly fit in the first cylindrical section of said axial passage.

9. A fuel injection nozzle according to claim 7 further comprises check valve means provided in said conduit means for allowing the air flow from the combustion chamber to the air inlet port but blocking the flow in the opposite direction.

10. A fuel injection nozzle according to claim 7 wherein said nozzle body has formed therein a third chamber radially surrounding the first and second chambers and wherein the axial passage is in communication with the fuel inlet port through the third chamber.

11. A fuel injection nozzle according to claim 7, further comprising spring means for normally holding the piston in the first position.

12. A fuel injection nozzle according to claim 11, wherein the piston is formed integral with a stem slidably extending through and projecting out of one end of the nozzle body, the stem having a flange on its outer end, and wherein the spring means is a compression spring extending between the flange of the stem and said one end of the nozzle body.

13. A fuel injection nozzle according to claim 12, in combination with an actuating mechanism acting on the flange of the stem for moving the piston from the first to the second position against the force of the spring means.

* * * * *